US006004232A

United States Patent [19]

Sennott

[11] Patent Number: 6,004,232

[45] Date of Patent: Dec. 21, 1999

[54] APPARATUS AND METHOD FOR IMPROVED TAG GAME

[76] Inventor: Anita L. Sennott, 35 Buckridge Dr., Amherst, N.H. 03031

[21] Appl. No.: 09/111,948

[22] Filed: Jul. 8, 1998

[51] Int. Cl.[6] ..... A63B 71/00

[52] U.S. Cl. ..... 473/502; 473/415

[58] Field of Search ..... 473/502, 415

[56] References Cited

U.S. PATENT DOCUMENTS

| | | | |
|---|---|---|---|
| 2,986,396 | 5/1961 | Abbott et al. | 473/502 |
| 3,579,745 | 5/1971 | Wilson | 473/502 |
| 4,304,403 | 12/1981 | Wilson | 473/502 |
| 4,651,989 | 3/1987 | Wilson | 473/502 |
| 5,456,462 | 10/1995 | Wilson | 473/502 |
| 5,709,621 | 1/1998 | Wilson | 473/502 |

*Primary Examiner*—Sam Rimell
*Attorney, Agent, or Firm*—Davis and Bujold

[57] ABSTRACT

A tag game kit of parts comprising of a plurality of tag units. Each tag unit has a clothing attachment clip to which is rotatably connected, via a connecting ring, a colored, strip-like, fabric pennant. The tag game kit of parts is provided with at least three groups of tag units, each tag unit group being provided with pennants of a distinctive color, with each distinctive color being different from the colors of the other groups' pennants. For game play, at least two players divide into at least two groups, with each group being represented by the color of the groups' tag unit pennants. Each player, using the clips, attaches a number of tag units to the player's clothing. Then, the players chase after each other with the members of each team attempting to obtain the tag units of the other teams' members by grabbing and pulling the pennants and thus detaching the clips from the clothing. Once a player loses all of his or her tag units, that player is out of the game. If there are two teams, play ends when there is only one tag left, with the winning group being the player having the remaining attached tag unit. If there are more than two teams, play still ends when there is only one tag left, but the group with the highest number of captured tag units wins.

20 Claims, 3 Drawing Sheets

APPARATUS AND METHOD FOR IMPROVED TAG GAME

FIELD OF THE INVENTION

This invention relates to a unique set of components or playing a novel tag game and an improved method of laying a tag game.

BACKGROUND OF THE INVENTION

"Tag", as it is commonly called, has long been an easy, active and fun game for two or more people, typically children, to play. A first person is chosen at random to be "it". Then, that person runs after the other players and attempts to touch, e.g. "tag", one of the other players who, at the same time, is trying to keep his or her distance from the person who is "it". If a player is tagged, the person who is currently "it" exclaims "Tag, you're it!" or "You're it!", or some other similar expression, and the newly tagged person now is "it" and has to chase the others players. Since the game is open ended (i.e. there is no set ending point or goal), the game continues until the players become tired or bored. Sometimes, if a player who is slower than the other players is tagged, that player may quickly lose interest in the game if he or she cannot successfully tag someone else in a relatively short period of time.

One variant of tag is touch football. Touch football is played like conventional football, except that instead of tackling the player carrying the football, in order to stop play, another player has to touch the ball-carrying player with both hands. This results in fewer injuries and allows players to play football without any gear whatsoever except, of course, a football. However, one problem with touch football is that it is often difficult to determine whether or not a player carrying the football has actually been touched with both the hands of an opposing player. Disagreements over this can often arise, especially if there is no referee to mediate the game.

Flag football is a more accurate version of touch football. Each player affixes a belt around his or her waist carrying two (2) or more "flags" detachably connected thereto, e.g. one "flag" is detachably affixed on the player's right side and the other "flag" is detachably affixed on the player's left side. Each flag is generally a strip of flexible plastic or laminated fabric, typically ten to fourteen inches long and one to three inches wide, and hangs down the side of the player's leg. Numerous means have been devised to detachably connect the "flags" to the belt. One popular means is to use VELCRO™ brand hook/loop fasteners. Another means is to have a pair of ball joint receptacles on the belt, with one end of each "flag" being outfitted with a corresponding ball joint member.

Every player of each flag football team is provided with a flag belt, with the flags of each team being generally one of two (2) colors (flag football sets are sold with a number of belts, and a number of flags of one color and a number of flags of another color). During play, if one of the "flags" of a ball-carrying player is detached (i.e. grabbed and yanked off) by an opposing player, the ball-carrying player is considered tagged or tackled, play stops, and the players regroup for another "play". The tagged player reattaches the detached flag and the game resumes.

SUMMARY OF THE INVENTION

Wherefore, it is an object of the present invention to overcome the aforementioned problems and drawbacks associated with the prior art design tag games by providing a new and innovative tag game.

The kit of parts for a tag game set, according to the invention, consists of a plurality of tag units. Each tag unit has a clothing attachment means, such as a clip, to which is connected, via a connecting ring, a colored, strip-like, fabric pennant. The tag game set is provided with at least two groups of tag units with each group of tag units having pennants of a distinctive color. Preferably, there are three or more tag units which comprise each group of tag units.

In order to play the game, the players divide into two or more groups (with the maximum number of groups depending on the number of different colored tag unit groups provided in the tag game set). Each group, therefore, is issued a group of tag units of a distinctive color. Each player generally attaches an equal number of tag units to the player's clothing by using the clips—the tag units can be clipped anywhere on the individual playing the tag game. Then the game begins and the players commence running after each other, with the members of each team attempting to obtain the tag units of the other teams' members by grabbing and pulling the pennants and thus detaching the clips from the clothing of other players. Once a player loses all of his or her tag units, that player is out of the game. If there are only two teams or individuals playing the game, play ends when there is only one tag left, with the winning team or individual being the person having the remaining tag unit. If there are more than two teams or individuals playing the game, play still discontinues when there is only one tag unit left, but the team or individual with the highest number of captured tag units wins.

Another object of the invention is to provide for a tag game having varying levels of game complexity.

A still further object of the present invention is to provide tag game units which are relatively durable but still relatively easy and economical to manufacture.

Yet another object of the present invention is to provide a tag game that can be played during the daytime or nighttime as well as indoors or outdoors.

A further object of the present invention is to provide a new tag game that can be played by people of all ages, and that allows for individual as well as both small group and large group play.

Still another object of the invention is to provide a new game that promotes physical activity and provides a tag game that is easy for young children to understand, yet sophisticated enough to hold their interest for longer periods of time than conventional tag games.

BRIEF DESCRIPTION OF THE DRAWINGS

The invention will now be described, by way of example, with reference to the accompanying drawings in which.

DESCRIPTION OF THE PREFERRED EMBODIMENTS

Figure 1:
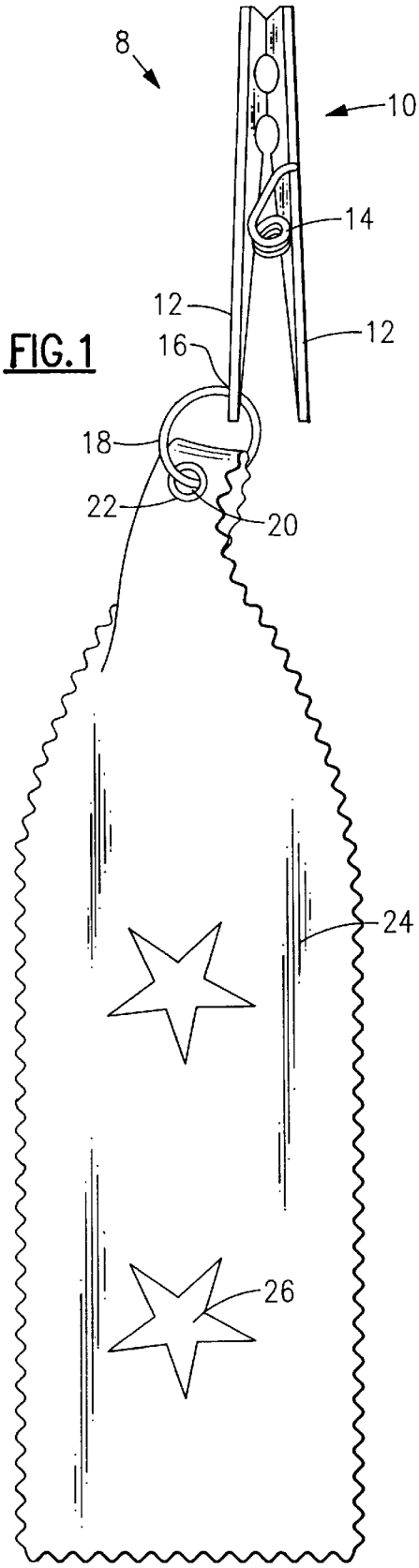
FIG. 1 is a diagrammatic front elevational view of a tag unit according to the invention.
Figure 2:
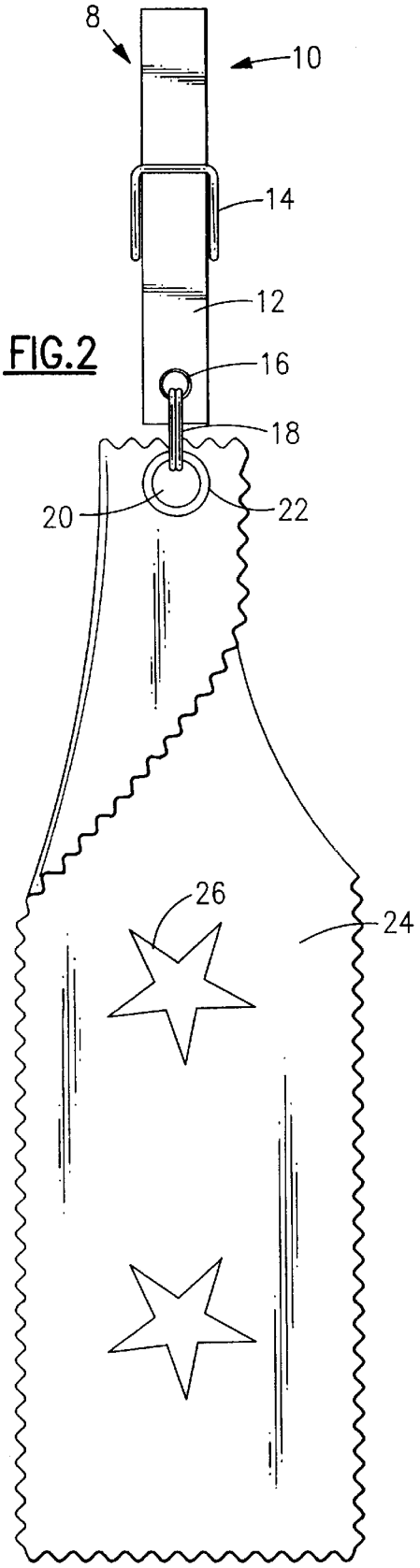
FIG. 2 is a diagrammatic left side elevational view of a tag unit according to the invention.

Turning now to FIGS. 1–3, a detailed description concerning the present invention will now be provided.

Tag Game Apparatus

With reference to FIGS. 1 and 2, a tag unit 8 according to the present invention can be seen. A clothing attachment means 10, here a clothespin-like clip (see also FIG. 3B), has two mating clip handles 12, a clip spring 14, and a circular aperture 16 (hereinafter called a "clip hole") disposed in at least one of the clip handles adjacent a free end thereof. The clip spring 14 is coupled to a central area of both of the clip handles, in a conventional manner, and biases a first mating pair of opposed ends of the two clip handles 12 into engagement with one another for grasping clothing of an individual playing the tag game. When a player desires to attach the clothing attachment means 10, the player merely squeezes the opposite end of the two clip handles 12 in a conventional manner.

A split ring 18 (see also FIG. 3C) is positioned through the clip hole 16 of one of the clip handles 12 in a conventional manner. The split ring 18 is also positioned, in a conventional manner, through an eyelet 20 (supported by an eyelet rivet 22) disposed in an overlapped portion located at one end of a pennant 24. It is to be appreciated that the pennant 24 may be provided with decorations 26, e.g. stars, squares, animals, insignias, etc., which preferably include or incorporate a conventional 'glow-in-the-dark' substance or material to add visibility of the pennant for playing the tag game at nighttime.

Figure 3A:
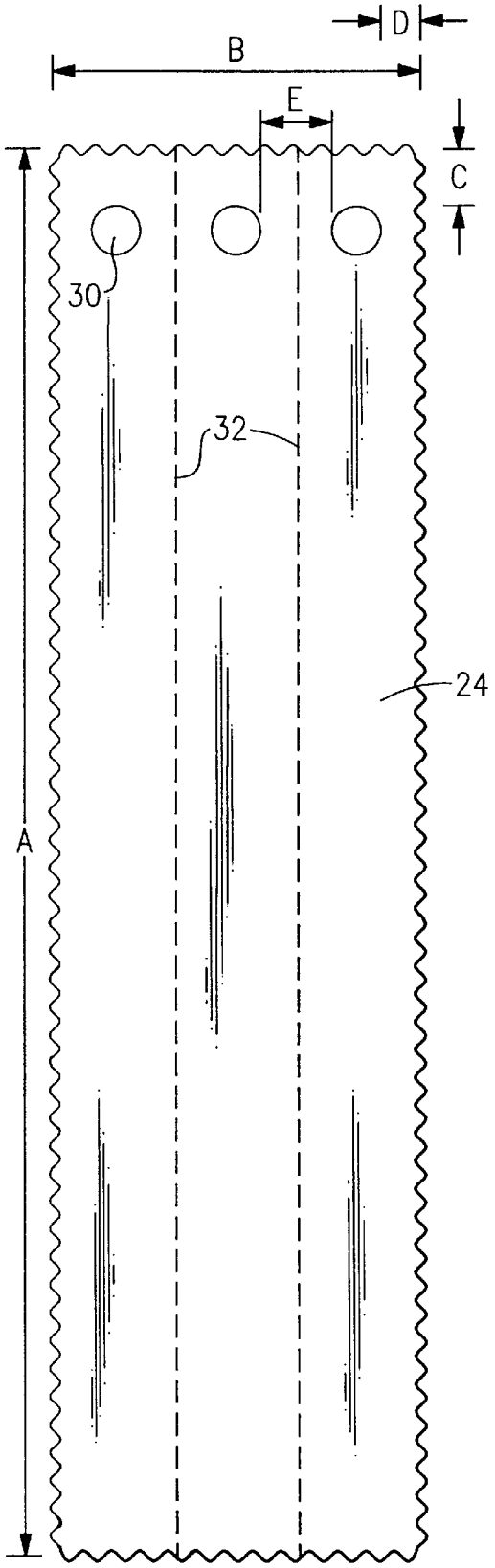
FIG. 3A is a diagrammatic front elevational view of a pennant prior to manufacture.
Figure 3B:
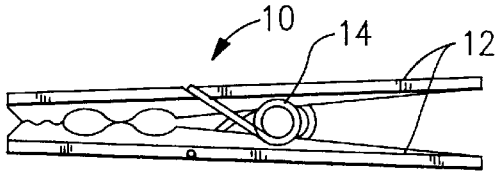
FIG. 3B is a diagrammatic front elevational view of a clothespin-like clip prior to manufacture.
Figure 3C:
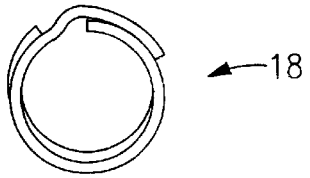
FIG. 3C is a diagrammatic front elevational view of a split ring prior to manufacture.
Figure 3D:
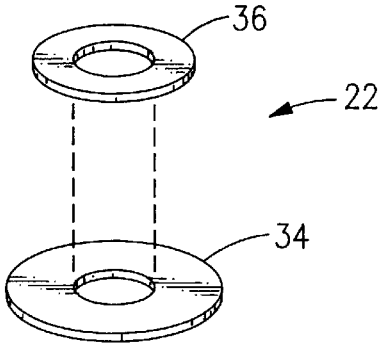
FIG. 3D is a diagrammatic front elevational view of an enlarged eyelet rivet prior to manufacture.

FIG. 3A shows a pennant 24 (approximately at a 2:3 scale) before assembly. Dimension A of the pennant 24 is approximately twelve inches (12") in length while dimension B is approximately three inches (3") in length. Three eyelet holes 30 are formed and spaced across the top portion of each pennant 24, with dimensions C and E being approximately one-half inch (0.5") or so and dimension D being approximately one-quarter inch (0.25"). It is to be appreciated that the above dimensions can vary, from application to application, and are only provided as a preferred example of the present invention. The pennant 24 is preferably manufactured from a flexible, tear-resistant fabric and may, if desired, be cut so as to have decorative longitudinal perimeter edges.

During assembly, the pennant 24 is folded upon itself, in an accordion-like fashion, along fold lines 32 so that the three eyelet holes 30 are aligned with one another. A first portion 34 of the eyelet rivet 22 is positioned on one side of the three aligned eyelet holes 30 and a second mating portion 36 of the eyelet rivet 22 (see FIG. 3D) is positioned on the opposite side of the three aligned eyelet holes 30 and passes therethrough. A conventional rivet crimping device (not shown in the Figures) is then used to crimp the first and second mating portions of the eyelet rivet 22 to one another and form a permanent eyelet 20. To complete assembly of the pennant 4, the split ring 18 is then threaded through, in a conventional manner, both the eyelet 20 of the pennant 24 and one of the clip hole 16 of the clip handles 12. This assembly results in the pennant 24 being rotatably connected to the clip 10.

Figure 5:
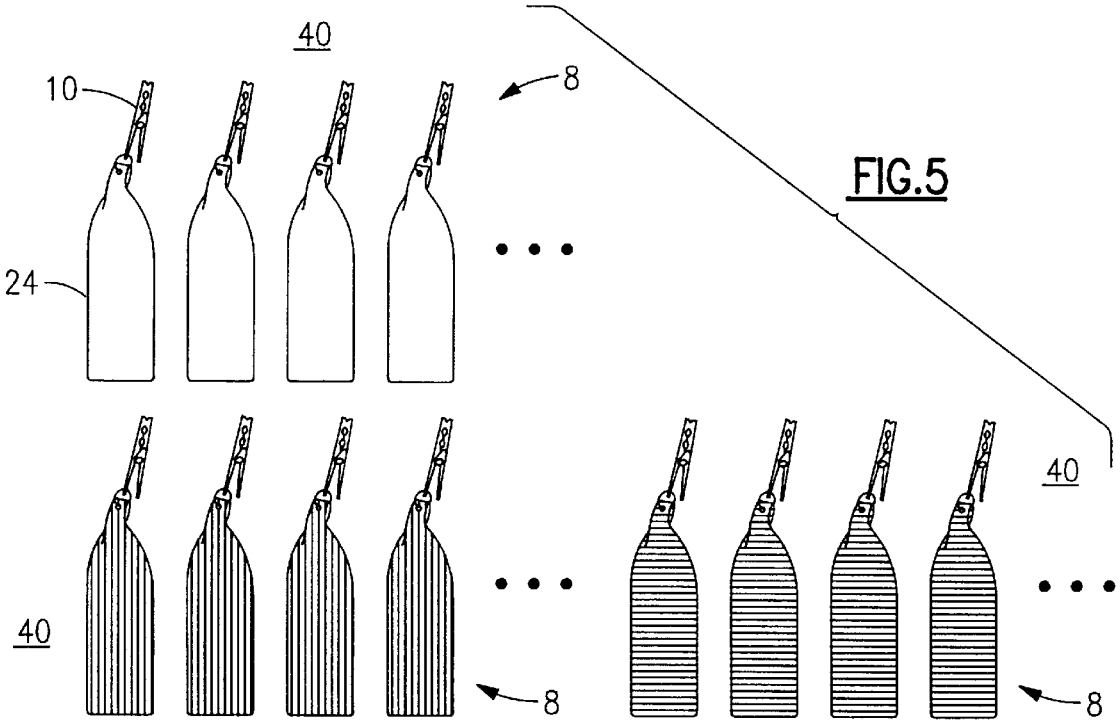
FIG. 5 shows a plurality of tag units forming a tag game set according to the present invention.

With reference to FIG. 5, a kit of parts comprising the tag game set, according to the present invention, can be seen. For a complete tag game set, at least two tag unit groups 40 are provided. Preferably, the tag game set comprises three to five tag unit groups 40. Each tag unit group 40 has at least three, preferably four to eight separate tag units 8 all of the same distinctive color. In a preferred form of the invention, there are fifteen or more tag units per tag unit group.

The pennants 24 in each tag unit group 40 are of one and the same distinctive color. Thus, for example, the pennants 24 of a first tag unit group 40 are white, the pennants 24 of a second tag unit group 40 are red, the pennants 24 of a third tag unit group are blue 40, the pennants 24 of a fourth tag unit group 40 are green, etc.

Playing The Tag Game

In order to play the tag game, according to the present invention, there must be at least two players, with the total number of allowable players only being limited by the number of available tag unit groups and/or tag units. The players divide into two or more groups, with each group having at least one player. The total number of groups allowable depends on the number of available tag unit groups. Since each tag unit group has pennants of one and the same distinctive color, each player group likewise has a distinctive color.

Once the groups are determined, the tag units of each tag unit group are distributed among the players. Preferably, each player should get three or more tag units, although the exact number of tag units may vary. However, each player should have the same number of tag units or, conversely, each player group should have the same total number of tag units. The players, using the clips 10, then attach each distributed tag unit to a portion of his or her clothing, as can be seen in FIG. 4.

Figure 4:
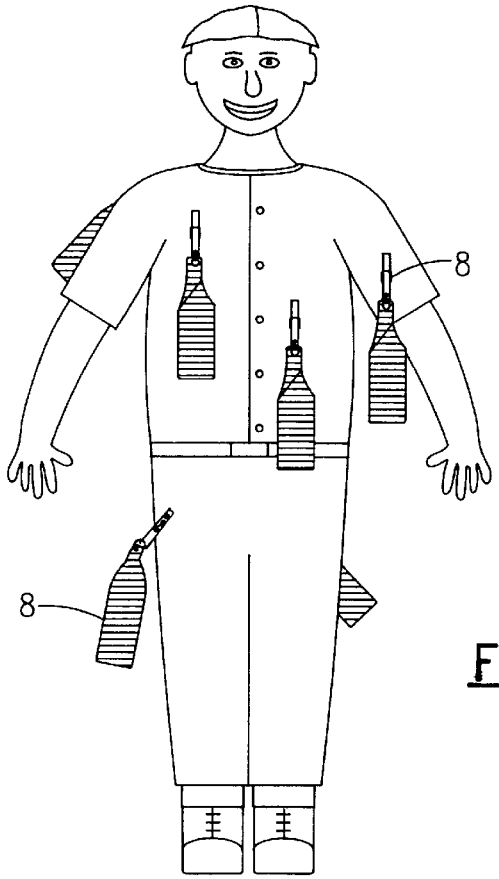
FIG. 4 is a diagrammatic view showing a player having a plurality of tag units affixed to his or her clothing.

With reference to FIG. 4, a player having six tag units attached to his clothing, at various random and spaced apart locations, can be seen. The exact positioning of the tag units is not vital, although a somewhat even distribution of the tag units is best. For safety, the tag units should not be placed below the knees, or on body parts (such as fingers, ears, or hair). An adult playing with children may limit placement of his or her tag units to the waist or below in order to allow shorter or younger children to readily grab the attached tag units.

During play, the players may elect to establish boundary lines or a "playing area" for game play. For example, the "playing area" may be a front or back yard, or both, a marked athletic field or a park lawn, etc. For night play, it is especially important to have a defined "playing area" in order to ensure that children do not encounter unsafe obstacles, wander off, or enter traffic lanes.

Once the tag units are affixed to each player and all the players are ready, the tag game play begins. The players commence chasing after one another, with the member or members of each player group attempting to grab, remove and/or capture the tag units from any player of the other group(s). Each player keeps the tag units in hand that the player has successfully captured. Once a player loses all of his or her attached tag units, that player is out of the game and can no longer continue to chase other players or grab tag units. The "tagged out" player should then leave the "playing area" and await the end of the game.

The game is over once there is only one attached tag unit remaining, or if there is only one player or player group with still attached tag units. If there are only two player groups, the player group with the remaining attached tag unit(s) is declared the "winner". If there are three or more player groups, there are two manners for determining the "winner". The first manner is to declare the last player group to have any remaining attached tag unit(s) the "winner". The second manner is to declare the player group that has successfully detached the greatest number of the other groups' tag units. The players generally decide the manner for determining the "winner" prior to playing a game. In the latter case, once all of the tag units are detached, play ceases, and each group counts the total number of captured tag units, including the tag units that were captured by players who were tagged out of the game.

For night time play, it is preferred that the tag units incorporate one or more glow-in-the-dark decorations which are exposed to a bright light source, e.g. a light bulb for a prolonged period of time such as three or more hours, before game play commences. Alternatively, the tag units may be exposed to a "black light" (e.g. high UV light) immediately before play, or at least one conventional or black light may be set up to illuminate the game play area. Night time game play is carried out in a manner similar to day time play.

Although the pennants of the tag units, according to the invention, are illustrated as having particular dimensions, one of ordinary skill in the art will appreciate that pennants of other dimensions could be utilized without departing from the spirit and scope of the invention.

In addition, although the pennant material is indicated as being a fabric, other materials, such a plastic strips, plastic coated fabric, rubber strips, cord or yarn may also be employed. For night time play, as an alternative to glow-in-the-dark decorations, the pennants could be made from a glow-in-the-dark material. Also, the pennant material may be waterproof for play in water.

Furthermore, although the tag units according to the invention are illustrated as having clothing attachment means that are clothespin-like clips, one of ordinary skill in the art will appreciate that other conventional and well known attachment means, including other types of clips, VELCRO, etc., could be used without departing from the spirit and scope of the invention.

Although the tag unit pennant is shown as being attached to the clip, via an eyelet and a split ring, one of ordinary skill in the art will appreciate that the pennants could be attached to the clips in some other conventional manner, such as with string, with a direct knot, or with an integral rivet, etc., without departing from the spirit and scope of the invention.

Also, while the eyelet is shown as having been made on one pennant by cutting a plurality of eyelet holes into the pennant and folding the pennant into thirds so that the eyelet holes are aligned, and securing the aligned holes with an affixed eyelet rivet, one of ordinary skill in the art will appreciate that an eyelet could be formed by folding a pennant not having precut eyelet holes and affixing an eyelet rivet by using an eyelet rivet device that simultaneously cuts the holes and affixes an eyelet rivet.

Although the pennant, according to the invention, is shown as having an eyelet created through a folded portion, one of ordinary skill in the art will appreciate that an eyelet could be formed in a pennant without folds.

Also, although the tag unit pennant is illustrated as having star-shaped, glow-in-the-dark decorations disposed thereon, one of ordinary skill in the art will appreciate that other styles and types of decorations, whether glow-in-the-dark or otherwise, could be substituted without departing from the spirit and scope of the invention.

Although the method for playing the tag game with the tag game set, as disclosed herein, is described as having a goal of only having one player group with remaining tag units, one of ordinary skill in the art will appreciate that the tag game set could be used with chase and tag games having other goals. For example, in a game of "Capture the Flag", each of the players on each group or team could be outfitted with tag units, and instead of a player being out of the game upon being tagged with a hand, a player would only be out of the game only after having all of his or her tag units are removed. Of course, the winning team would still be the team that captured the opposing team's flag.

Since certain changes may be made in the above described tag game apparatus and method, without departing from the spirit and scope of the invention herein involved, it is intended that all of the subject matter of the above description or shown in the accompanying drawings shall be interpreted merely as examples illustrating the inventive concept herein and shall not be construed as limiting the invention.

Wherefore, what is claimed is:

1. A kit of parts for use in playing an improved tag game, the kit of parts comprising a plurality of detachable tag units with each tag unit comprising:

at least one pennant of a distinctive color;

a clothing attachment mechanism for releasable attachment to an article of clothing of a player; and a coupling device for permanently coupling one end of the pennant of the distinctive color to the clothing attachment mechanism;

wherein the tag units are grouped into at least first, and second tag unit groups, each pennant of the first tag unit group is of the same distinctive color, each pennant of the second tag unit group is of the same distinctive color, and the distinctive color of the first, and second tag unit groups are different from one another.

2. The kit of parts according to claim 1, wherein the clothing attachment means for detachably connecting the pennant to an article of clothing is a clip.

3. The kit of parts according to claim 2, wherein the pennant is rotatably connected to the clip via a split ring.

4. The kit of parts according to claim 2, wherein the clip comprises a first clip handle and a second clip handle, the first clip handle is pivotally connected to the second clip handle via a spring; and a clip hole is provided in at least one of the clip handles.

5. The kit of parts according to claim 4, wherein the pennant is provided with an eyelet and the split ring is attached to both the clip, via the clip hole, and to the pennant, via the eyelet, to provide a rotatable connection therebetween.

6. The kit of parts according to claim 1, wherein each of the tag unit groups has at least three detachable tag units.

7. The kit of parts according to claim 1, wherein each of the tag unit groups has at least four detachable tag units.

8. The kit of parts according to claim 1, wherein the kit of parts includes a third tag unit group, the pennants of the third tag unit group are all of the same distinctive color, and the distinctive color of the first, second and third tag unit groups are different from one another.

9. The kit of parts according to claim 8, wherein the kit of parts includes a fourth tag unit group, the pennants of the fourth tag unit group are all of the same distinctive color, each of the four tag unit groups has at least four detachable tag units, and the distinctive color of the first, the second, the third and the fourth tag unit groups are all different from one another.

10. The kit of parts according to claim 8, wherein the pennants of the first tag unit group are white, the pennants of the second tag unit group are blue, and the pennants of the third tag unit group are red.

11. The kit of parts according to claim 1, wherein each of the pennants also includes glow-in-the-dark material thereof.

12. The kit of parts according to claim 11, wherein the glow-in-the-dark material is a decoration affixed to each of the pennants, and the decoration comprises a glow-in-the-dark substance.

13. A kit of parts for use in playing an improved tag game, the kit of parts comprising a plurality of detachable tag units with each tag unit comprising:

a pennant of a distinctive color;

a clothing attachment mechanism for releasable attachment to an article of clothing of a player; and a coupling device for permanently coupling one end of the pennant of the distinctive color to the clothing attachment mechanism;

wherein the tag units are grouped into at least first, second and third tag unit groups, the pennant of the first tag unit group are all of the same distinctive color, the pennant of the second tag unit group are all of the same distinctive color, and the pennant of the third tag unit group are all of the same distinctive color, and the distinctive color of the first, the second, and the third tag unit groups are different from one another;

each of the pennants also includes glow-in-the-dark component to facilitate night time play of the tag game.

14. The kit of parts according to claim 13, wherein the clothing attachment means for detachably connecting the pennant to an article of clothing is a clip and the pennant is rotatably connected to the clip via a split ring;

the clip comprises a first clip handle and a second clip handle, the first clip handle is pivotally connected to the second clip handle via a spring; and a clip hole is provided in at least one of the clip handles.

15. A method of playing an improved tag game with at least three players comprising the steps of:

providing a kit of parts dividing the at least three players into at least three player groups with each player group having at least one player;

assigning one of the first, the second and the third tag unit groups to each one of the at least three player groups with each one of the player groups having an equal number of the tag units;

detachably affixing all of the assigned tag units to clothing of the players;

once the assigned tag units are affixed to clothing, commencing the improved tag game by having the players chase after one another and detach and capture the affixed tag units of the other player groups;

eliminating any player once all of the affixed tag units of that player are detached; and stopping play once there is only one player group still having at least one affixed tag unit.

16. The method for playing an improved tag game according to claim 15, further comprising the step of declaring as a winner the player group still having the at least one affixed tag unit.

17. The method for playing an improved tag game according to claim 15, further comprising the steps of:

counting the number of tag units each player captures from the other player groups; and declaring as a winner the player group capturing the greatest number of tag units.

18. The method for playing an improved tag game according to claim 16, further comprising the step of establishing a playing area within which the improved tag game must be played.

19. The method for playing an improved tag game according to claim 15, further comprising the step of coloring the pennants of the first tag unit group white, coloring the pennants of the second tag unit group blue, and coloring the pennants of the third tag unit group red.

20. The method for playing an improved tag game according to claim 15, further comprising the step of providing a fourth tag unit group;

the pennants of the fourth tag unit group are all of the same distinctive color; and the distinctive color of the fourth tag unit group is different from the distinctive color of the first, the second, and the third tag unit groups.

* * * * *